United States Patent [19]

Shannon et al.

[11] 4,421,367

[45] Dec. 20, 1983

[54] GROUNDING SPRING FOR BUS DUCT PLUG-IN UNITS

[75] Inventors: Bill M. Shannon, Rochester Township, Beaver County; Charles L. Weimer, Patterson Heights, both of Pa.

[73] Assignee: Westinghouse Electric Corp., Pittsburgh, Pa.

[21] Appl. No.: 287,842

[22] Filed: Jul. 29, 1981

[51] Int. Cl.[3] ..... H01R 4/66

[52] U.S. Cl. ..... 339/14 R; 339/22 B

[58] Field of Search ..... 339/19 R, 22 B

[56] References Cited

U.S. PATENT DOCUMENTS 4,082,393 4/1978 Gamble ..... 339/22 B X

OTHER PUBLICATIONS

UL 857, "Standard for Busways and Associated Fittings", Underwriters Laboratories, Inc., Mar. 17, 1980.

*Primary Examiner*—Eugene F. Desmond

*Attorney, Agent, or Firm*—M. J. Moran

[57] ABSTRACT

A bus duct assembly characterized by a bus duct section having top and bottom walls and opposite side walls forming a housing, and a plurality of multi-phase bars supported within the housing. A tap box wall having a plurality of terminals and being mounted on top of the bus duct thereby connecting the bus bars with the terminals. A ground spring connected to the tap box for maintaining continuous electrical ground between the tap box enclosure and the bus duct housing before the terminals are energized by the bus bars and after the plurality of terminals are deenergized from the bus bars.

2 Claims, 3 Drawing Figures

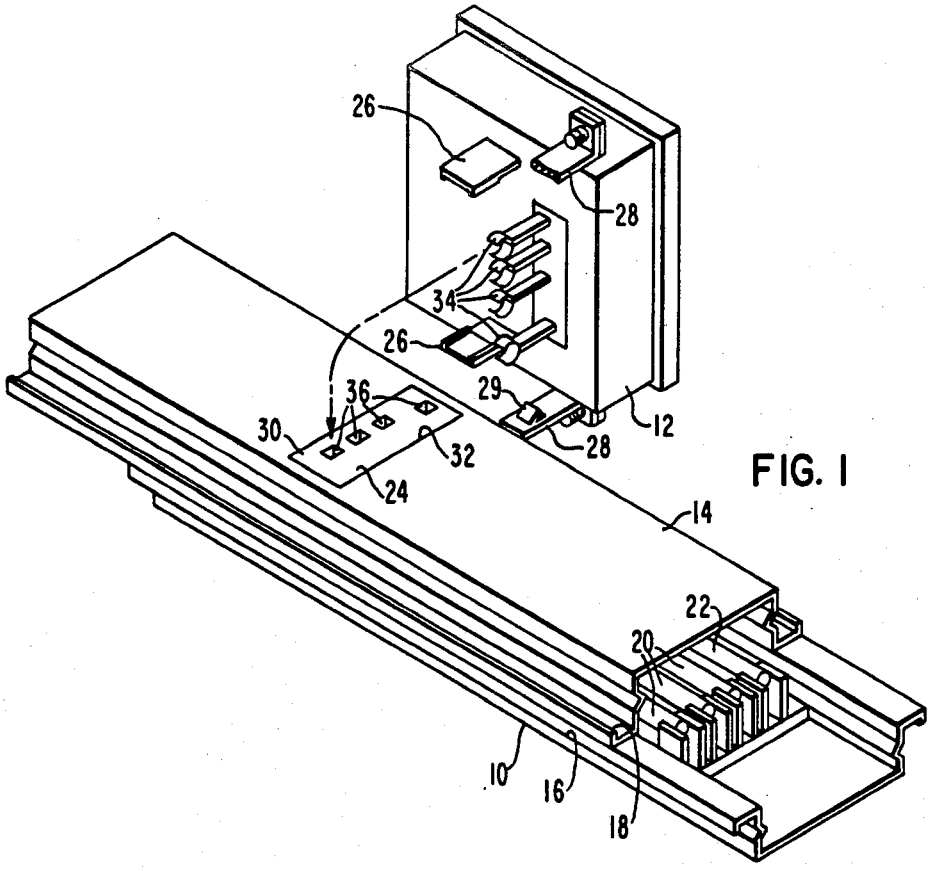
FIG. 1
FIG. 2
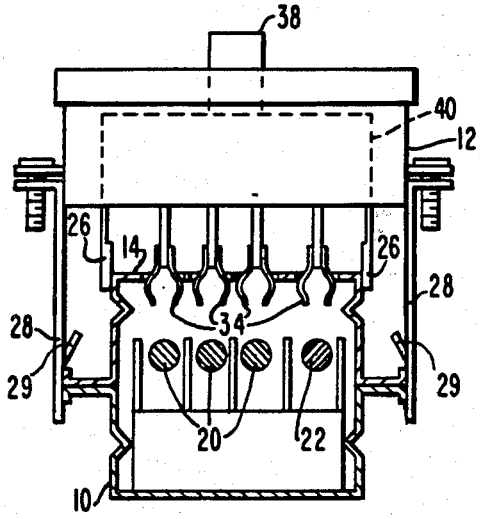
FIG. 3
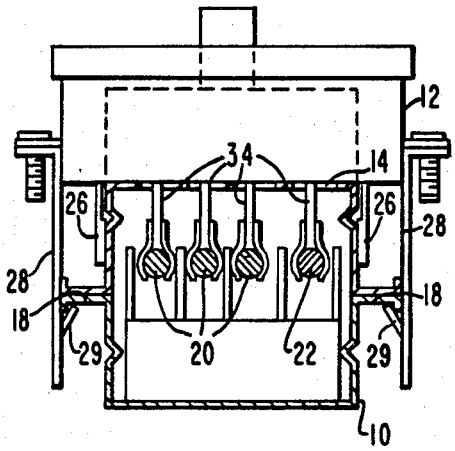

GROUNDING SPRING FOR BUS DUCT PLUG-IN UNITS

BACKGROUND OF THE INVENTION

This invention relates, generally, to bus duct apparatus for use with plug-in units and more particularly to a grounding spring to ground the plug-in unit to the bus duct before the phase stabs of the plug-in unit make contact with the bus bars of the duct.

Most duct assemblies when installed with associated accessories such as plug-in power take-off units have generally required a make-shift operation to ensure proper enclosure to enclosure grounding. However, recent requirements by testing institutions such as Underwriter Laboratories with reference to Section 857, and the National Electrical Code of 1981, Article 250-99, mandate more reliable grounding between plug-in units and the associated bus duct. This has led to the requirement that the housing of the plug-in unit be grounded to the bus duct housing before the phase stabs contained in the plug-in unit make contact with the bus bars contained in the bus duct and that upon the removal of a plug-in unit, this ground between the plug-in unit and the bus duct housing be broken only after the phase stabs break contact with the bus bars.

It would be advantageous to provide a means whereby the bus duct enclosure is grounded to the plug-in unit enclosure before the phase stabs are energized by the bus bars and break ground only after the phase stabs are deenergized while still utilizing existing plug-in units and bus duct housings. Also advantageous would be a means of accomplishing such grounding in a relatively inexpensive manner which is easy to manufacture and install.

SUMMARY OF THE INVENTION

Briefly stated, a bus duct assembly comprising a bus duct section having top and bottom walls and opposing side walls thereby forming a housing has a plurality of multi-phase bars supported therein. An opening is presented on the top or bottom wall of the bus duct section thereby permitting the insertion of a tap box. The tap box is detachably attached at the opening and has a plurality of terminals which facilitate connection to the multi-phase bars in the bus duct section. Attached to the tap box are grounding springs which make or break electrical contact with the side walls of the bus duct section before or after the terminals make or break contact with the multi-phase bars respectively.

BRIEF DESCRIPTION OF THE DRAWINGS

Reference is now made to the description of the preferred embodiment illustrated in the accompanying drawings, in which:

FIG. 1 is an isometric view of a bus duct section showing a plug-in power take-off unit positioned for placement on the bus duct section;

FIG. 2 is a vertical sectional view taken through FIG. 1 showing the plug-in unit being mounted on the bus duct; and FIG. 3 is the same sectional view as that shown in FIG. 2 with the plug-in unit fully mounted on the bus duct.

DESCRIPTION OF THE PREFERRED EMBODIMENT

Referring now to FIG. 1, there is shown an isometric view of a bus duct section showing a plug-in power take-off unit positioned for placement on a bus duct section. A more detailed description of the bus duct and plug-in unit may be found in U.S. Pat. No. 4,082,393, "Bus Duct Assembly" issued Apr. 4, 1978 to Gamble and therefore only a brief description will be found below. A portion of a bus duct system of electrical power distribution comprises a bus duct section 10 of a bus duct and a plug-in power take-off unit 12 adapted to tap power from the bus duct. The bus duct section 10 comprises a housing including a generally U-shaped sheet metal upper part 14 and a similar lower part 16. The parts 14 and 16 are connected together at flange portions 18 at each of two opposite sides thereof. Three phase-carrying bus bars 20 and a neutral bar 22 are supported within the housing in a generally parallel relationship by means of an insulating bus support member of a plug-in type generally indicated at 24. The bus support member 24 includes an upper surface 30 which extends through an opening 32 in the upper part 14. The keyed terminal openings 36 facilitate the connection of the terminals 34 with the three phase bars 20 and neutral bar 22, permitting insertion of the plug-in unit 12 into the bus duct section 10 in only one configuration. The plug-in unit 12 serves as a housing for a three-pole circuit breaker (shown in FIGS. 2 and 3 as 40). The plug-in unit 12 is secured in place by two mounting brackets 28, each of which have an inturned ear 29 which engage the flange portions 18 on opposite sides of the bus duct section 10. Also attached to the plug-in unit 12 are grounding clips 26 which engage the side walls of the upper part 14 of the bus duct section 10 thereby making electrical contact. The ground clips 26 are made of a resilient spring-type steel so as to be capable of repeated insertions and extractions of the plug-in unit 12.

Referring now to FIG. 2, there is shown a vertical sectional view taken through FIG. 1 with the plug-in unit 12 partially engaged in the bus duct section 10. Upon the insertion of the plug-in unit 12, the ground clips 26 begin to engage the side walls of the upper part 14 before the terminals 34 engage the three-phase bars 20 and the neutral bar 22. This therefore allows electrical grounding of the plug-in unit 12 enclosure with the bus duct section 10 before energization of the terminals 34. The terminals 34 are connected to a three-phase circuit breaker generally indicated at 40 having a manually operable handle 38.

Referring now to FIG. 3, there is shown a plug-in unit 12 fully engaged with the bus duct section 10. The mounting brackets 28 are fully engaged with the flange portions 18 with the use of the inturned ear 29. This therefore prevents the plug-in unit 12 from being disengaged from the bus duct section 10. In order for the plug-in unit 12 to be removed from the bus duct section 10, the mounting brackets 28 are loosened thereby disengaging the inturned ear 29 from the flanged portions 18. The terminals 34 would therefore disengage from the three-phase bars 20 and neutral bar 22 with the ground clips 26 being disengaged from the upper part 14 after the terminals 34 have been deenergized.

It is to be understood that differing current carrying configurations may be utilized in the present invention such as, for example, direct current or single-phase current power sources. Additionally, the ground clips 26 may be made of different material such as, for example, aluminum or copper, without departing from the spirit and scope of the present invention.

Thus, the disclosed invention provides a relatively simple and inexpensive method of providing for grounding between a bus duct unit and its associated plug-in unit which may also be added to existing equipment inventories. Additionally, the present invention is available for use with previously installed bus duct systems thereby increasing personnel safety from potentially hazardous conditions.

What we claim is:

1. A bus duct assembly, comprising:

a bus duct section having top and bottom walls and opposite side walls so as to form a housing;

a bus bar supported within said housing;

an opening on said top wall for providing external access to said bus bar;

a tap box detachably attached at said opening, and having a terminal there-within for connection to said bus bar; and a pair of spaced apart grounding means connected to said tap box each for cooperating with the other by making compressive electrical contact with opposite side walls of said bus duct section before said terminal makes contact with said bus bar.

2. A bus duct assembly, comprising:

a bus duct section having top and bottom walls and opposite side walls so as to form a housing;

a bus bar supported within said housing;

an opening on said bottom wall for providing external access to said bus bar;

a tap box detachably attached at said opening, and having a terminal there-within for connection to said bus bar; and a pair of spaced apart grounding means connected to said tap box each for cooperating with the other by making compressive electrical contact with opposite side walls of said bus duct section before said terminal makes contact with said bus bar.

* * * * *